US011441285B2

(12) United States Patent
Zakrzewski

(10) Patent No.: US 11,441,285 B2
(45) Date of Patent: Sep. 13, 2022

(54) TOOL AND METHOD FOR FORMING PILES

(71) Applicant: PPX TECHNOLOGY PTY LTD, Daisy Hill (AU)

(72) Inventor: Przemyslaw Adam Zakrzewski, Daisy Hill (AU)

(73) Assignee: PPX TECHNOLOGY PTY LTD, Daisy Hill (AU)

( * ) Notice: Subject to any disclaimer, the term of this patent is extended or adjusted under 35 U.S.C. 154(b) by 32 days.

(21) Appl. No.: 17/049,079

(22) PCT Filed: Apr. 23, 2019

(86) PCT No.: PCT/AU2019/050359
§ 371 (c)(1),
(2) Date: Oct. 20, 2020

(87) PCT Pub. No.: WO2019/204866
PCT Pub. Date: Oct. 31, 2019

(65) Prior Publication Data

US 2021/0254299 A1 Aug. 19, 2021

(30) Foreign Application Priority Data

Apr. 25, 2018 (AU) ..... 2018901373

(51) Int. Cl.
*E02D 7/22* (2006.01)
*E02D 5/44* (2006.01)
*E02D 5/66* (2006.01)

(52) U.S. Cl.
CPC ..... *E02D 7/22* (2013.01); *E02D 5/44* (2013.01); *E02D 5/665* (2013.01)

(58) Field of Classification Search
CPC combination set(s) only.
See application file for complete search history.

(56) References Cited

U.S. PATENT DOCUMENTS 6,030,050 A * 2/2000 Ichikawa ..... B60B 7/04 301/37.109
6,079,906 A 6/2000 Herrero Codina
(Continued)

FOREIGN PATENT DOCUMENTS

DE 19935813 2/2001
EP 0517329 12/1992
(Continued)

OTHER PUBLICATIONS

International Search Report and Written Opinion for International (PCT) Patent Application No. PCT/AU2019/050359, dated Jul. 12, 2019, 9 pages.
(Continued)

*Primary Examiner* — Kyle Armstrong
(74) *Attorney, Agent, or Firm* — Sheridan Ross P.C.

(57) ABSTRACT

The present invention provides a tool for forming an underground cast-in-situ pile having an enlarged base, the tool comprising: a first pile-forming member having a first base-forming member; a second pile-forming member having a second base-forming member, the pile-forming members extending collinearly and being movable in a longitudinal direction relative to one another between: a digging state wherein the base-forming members are proximate to one another so that the pile-forming members can be driven underground; and a base-forming state wherein the base-forming members are spaced from one another so as to form an underground void between the first and second base-forming members, the void being tillable with a flowable fill to form the enlarged base of the underground cast-in-situ pile; and jack screw means, rotation of which causes relative longitudinal movement between the pile-forming members.

15 Claims, 7 Drawing Sheets

(56) References Cited

U.S. PATENT DOCUMENTS

| | | | | |
|---|---|---|---|---|
| 7,591,329 | B2 | 9/2009 | Perpezat et al. | |
| 11,142,878 | B1 * | 10/2021 | Aleali | E02D 5/26 |

FOREIGN PATENT DOCUMENTS

| | | |
|---|---|---|
| EP | 0853162 | 7/1998 |
| GB | 2503918 | 1/2014 |

OTHER PUBLICATIONS

Extended Search Report for European Patent Application No. 19792576.1, dated Jan. 11, 2022, 8 pages.

* cited by examiner

TOOL AND METHOD FOR FORMING PILES

CROSS REFERENCE TO RELATED APPLICATIONS

This application is a national stage application under 35 U.S.C. § 371 and claims the benefit of PCT Application No. PCT/AU2019/050359 having an international filing date of 23 Apr. 2019, which designated the United States, which PCT application claimed the benefit of Australia Patent Application No. 2018901373 filed 25 Apr. 2018, the disclosures of each of which are incorporated herein by reference in their entireties.

TECHNICAL FIELD

The present invention relates to a tool for forming cast-in-situ foundation piles. The present invention also relates to a method for forming cast-in-situ foundation piles using said tool.

BACKGROUND

The cost of constructing a foundation pile depends on, among other things, the amount of material needed to construct the pile. Two practices for reducing the amount of material required are: (1) constructing a pile with an enlarged base; and (2) preloading the pile base.

Foundation piles with enlarged bases may achieve a similar or greater loading and/or pull out capacity than foundation piles without enlarged bases while using similar or even less material (material such as concrete or grout).

Existing tools and methods for constructing foundation piles with enlarged bases typically require underreaming of a pile shaft to form a bulb at a base thereof. Such tools and methods often require temporary hole support in the form of steel casings or the like, and the use of several different tools.

Preloading (or prestressing) the base of a pile can enhance pile performance by inducing settlements prior to actual use of the foundation pile. This can better inform material usage, drilling depth and/or pile diameter.

However, existing methods for preloading the base of a pile typically require the use of grout under high pressure and various types of expanding sleeves or bags. To preload a pile base using pressure grouting, a hollow section or grout tubes and an expansion body have to be preinstalled in an underground void. Moreover, before pressure grouting can be performed, the pile shaft has to be formed and be of sufficient strength, and a secondary mobilisation to site is often required.

Existing tools and methods for forming piles with enlarged bases and for preloading piles can be relatively time, labour, and material-intensive, and thus costly.

Additionally, it can be difficult to determine the actual loading capacity of a foundation pile using existing piling tools and methods. As such, foundation piles are often excessively overengineered with design safety factors of three or more. This results in piling contractors digging deeper and installing wider and/or deeper foundation piles than are actually necessary, thereby increasing material and labour costs.

It is desired to overcome or alleviate one or more difficulties associated with existing piling tools and/or methods, or to at least provide a useful alternative.

SUMMARY

According to a first aspect of the present invention, there is provided a tool for forming an underground cast-in-situ pile having an enlarged base, the tool comprising:

- a first pile-forming member having a first base-forming member;
- a second pile-forming member having a second base-forming member, the pile-forming members extending collinearly and being movable in a longitudinal direction relative to one another between:
  - a digging state wherein the base-forming members are proximate to one another so that the pile-forming members can be driven underground; and
  - a base-forming state wherein the base-forming members are spaced from one another so as to form an underground void between the first and second base-forming members, the void being fillable with a flowable fill to form the enlarged base of the underground cast-in-situ pile; and
- jack screw means, rotation of which causes relative longitudinal movement between the pile-forming members. In the digging state, the base-forming members may physically engage one another, and the pile-forming members can be driven downwardly into the ground. Once drilled to a predetermined depth, the jack screw means can be rotated such that the base-forming members are separated from one another in a longitudinal direction. This separation of the base-forming members creates a notional void underground which has a diameter that approximates a diameter of the base-forming members. This notional void can be gradually filled with a flowable fill, such as mortar, concrete or grout, as the void is being created so as to form the enlarged base of the underground cast-in-situ pile.

In embodiments of the invention, the jack screw means is threadingly engaged with the first pile-forming member such that rotation of the jack screw means in one direction moves the pile-forming members into the digging state, and rotation of the jack screw means in the opposite direction moves the pile-forming members into the base-forming state. This power screw mechanism for moving the pile-forming members relative to one another is simple to operate and can be fitted to and used by existing excavators and piling rigs which are often already equipped with rotary heads which can be used to drive the jack screw means.

In embodiments of the invention, the jack screw means and the second pile-forming member are rotatable, but not longitudinally movable, relative to one another. To this end, the second pile-forming member may comprise a collar via which the jack screw means is secured to restrict relative longitudinal movement therebetween. A thrust bearing may be disposed between the jack screw and the second pile-forming member to enable relative rotation therebetween. In this way, rotation of the jack screw in a direction which drives the base-forming members towards the base-forming state results in either one pile-forming member being driven deeper into the ground, or the other pile-forming member being raised, depending on whether the former or the latter movement requires less torque. This will be influenced by the composition of the ground in which the pile-forming members are in.

In embodiments of the invention, the tool also comprises limiting means for limiting the extent to which the base-forming members can be spaced from one another. The limiting means may take the form of a collar extending from the jack screw means. In this way, when the pile-forming members are moved into the base-forming state, the first pile-forming member is brought into contact with and engages the collar, thereby restricting further longitudinal movement between the pile-forming members which would further increase the space between the base-forming members.

In embodiments of the invention, the pile-forming members are telescopically arranged and configured such that one pile-forming member cannot be rotated independently of the other pile-forming member.

In embodiments of the invention, the first pile-forming member is a first screw pile; the second pile-forming member is a second screw pile; the first base-forming member is a first helix; and the second base-forming member is a second helix. As such, the present tool may be realised by known screw/helical pile arrangements.

In embodiments of the invention, the first pile-forming member is a first blade pile; the second pile-forming member is a second blade pile; the first base-forming member is a first blade; and the second base-forming member is a second blade. As such, the present tool may be realised by known blade pile arrangements.

According to a second aspect of the present invention, there is provided a method of forming an underground cast-in-situ pile having a shaft and an enlarged base, the method using a tool of the first aspect of the invention and comprising:

(a) when the pile-forming members are in the digging state, driving the pile-forming members underground to a predetermined depth;

(b) moving the pile-forming members towards the base-forming state to form an underground void to which a flowable fill can be supplied;

(c) while moving the pile-forming members towards the base-forming state, supplying the flowable fill to the void so as to form the enlarged base of the underground cast-in-situ pile; and (d) driving the pile-forming members out of the ground while supplying the flowable fill underground to form the shaft of the cast-in-situ pile.

In embodiments of the method, step (b) further comprises:

(i) while moving the pile-forming members towards the base-forming state, determining the magnitude of a force required to move the pile-forming members towards the base-forming state;

(ii) if the magnitude of the determined force is below a threshold amount, repeating steps (a) and (b) at a deeper depth underground until the magnitude of the determined force is equal to or greater than the threshold amount; and (iii) when the magnitude of the determined force is equal to or greater than the threshold amount, continuing to move the pile-forming members towards the base-forming state while supplying the flowable fill to the void to form the enlarged base. It is possible to relate the load bearing capacity of a foundation pile with the force required to separate the base-forming members. As such, the method allows for a more accurate estimate of a load bearing capacity of a foundation pile if constructed at a certain depth before the foundation pile is installed.

In embodiments of the method, the force relates to a torque force applied to the jack screw means to move the pile-forming members towards the base-forming state. Therefore, the torque required to be applied to the jack screw means to move the pile-forming members towards the base-forming state can be indicative of a load bearing capacity of a foundation pile constructed at a certain depth underground.

In embodiments of the method, the force relates to an axial load carried by one or both of the pile-forming members. This axial load can be measured by one or more strain gauges fitted to the or each pile-forming member. The axial load and thus reading from the strain gauge(s) can also be indicative of the load bearing capacity of a foundation pile constructed at a certain depth underground.

DETAILED DESCRIPTION

Figure 1:
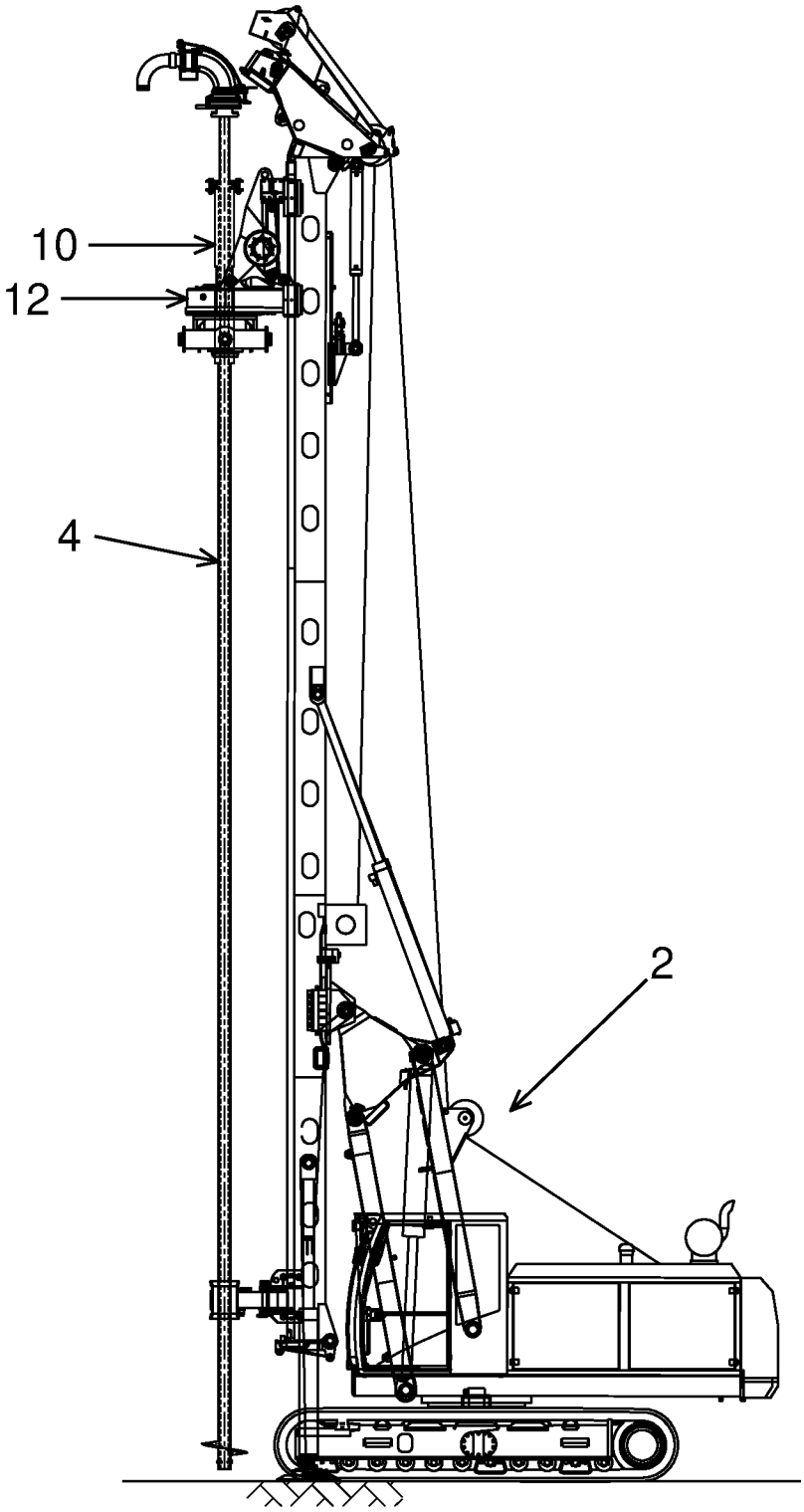
FIG. 1 is a side view of a tool according to embodiments of the present invention fitted to a piling rig.

FIG. 1 shows a piling rig 2 to which is fitted a tool 4 embodying the present invention. The tool 4 comprises longitudinally extending pile-forming members and a jack screw means 10. A rotary head 12 of the piling rig 2 can be used to selectively drive the jack screw means 10 and the pile-forming members.

Figure 2:
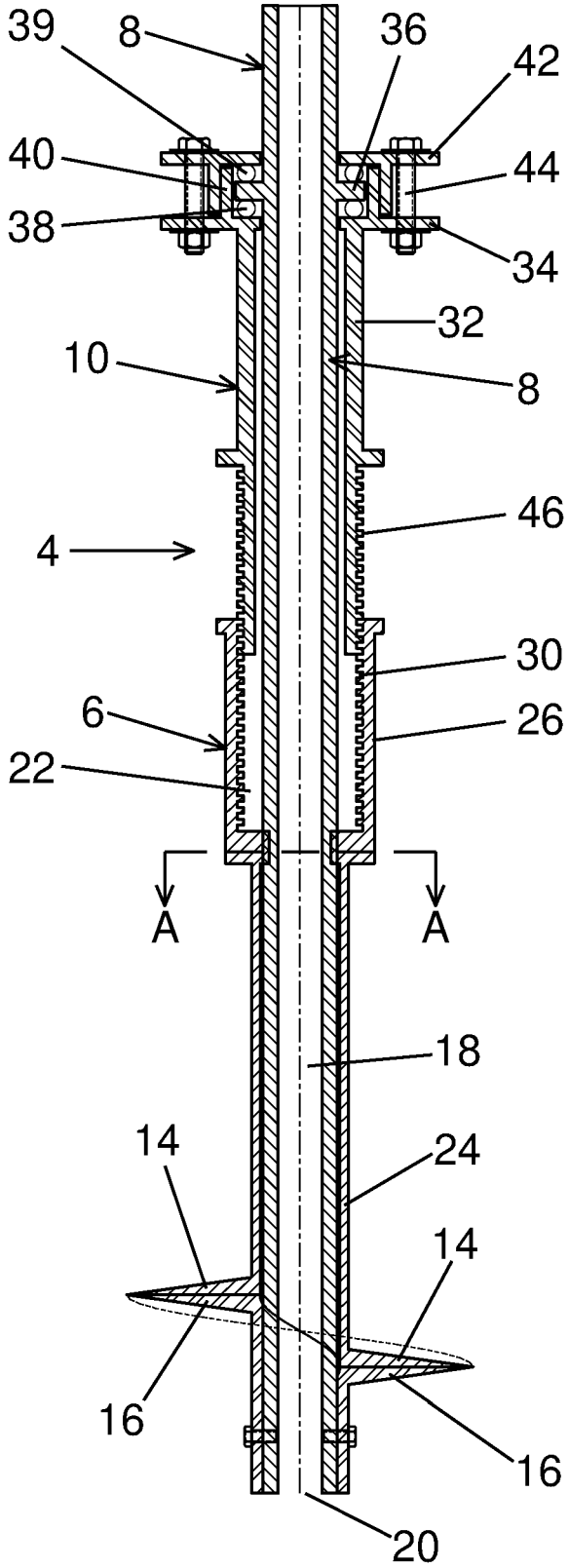
FIG. 2 is a cross sectional side view of the tool of FIG. 1 in a digging state.

FIG. 2 shows the tool 4 in greater detail. The tool 4 can be used to form an underground cast-in-situ pile having an enlarged base. The tool 4 comprises a first pile-forming member which is depicted in the Figures as an external screw pile 6. The external screw pile 6 has a first base-forming member which is depicted in the Figures as an upper helix 14. The tool 4 also comprises a second pile-forming member which is depicted in the Figures as an internal screw pile 8. The internal screw pile 8 has a second base-forming member which is depicted in the Figures as a lower helix 16.

The two piles 6 and 8 extend collinearly with one another and are telescopically arranged such that one can move in a longitudinal direction relative to the other. The tool 4 also comprises a jack screw means 10, henceforth referred to as a jack screw 10. Rotation of the jack screw 10 is configured to cause relative longitudinal translation between the two screw piles 6 and 8.

The internal screw pile 8 is tubular and comprises a longitudinally extending inner channel 18 through which a flowable fill, such as mortar, cement or grout, can be supplied from above. To form the shaft portion of a cast-in-situ pile, the flowable fill can exit through an outlet 20 at a lower end of the internal screw pile 8 as the tool is driven out of the ground. A lower end of the internal screw pile 8 carries the lower helix 16. In certain embodiments of the tool 4, the outlet 20 is closed by a sacrificial cap while the tool penetrates underground, not dissimilar to those used in respect of continuous flight auger piles. Of course the outlet 20 may be closed by other means to prevent soil from entering into the channel 18 of the internal pile 8 as the piles 6 and 8 are driven underground.

The external screw pile 6 extends in the longitudinal direction and defines a channel 22 through which the internal pile 8 passes through. The external pile 6 comprises a lower shaft section 24, which carries the upper helix 14, and an upper threaded section 26. The upper threaded section 26 has an external diameter that is larger than that of the lower shaft section 24. The threaded section 26 comprises a tubular cavity having an internal thread 30 which allows the external pile 6 to form a power screw engagement with the jack screw 10.

The jack screw 10 comprises a tubular body 32 through which the internal screw pile 8 extends in the longitudinal direction. An upper end of the tubular body 32 is releasably secured to the internal pile 8. To this end, the jack screw 10 comprises an upper rim 34, and the internal pile comprises a corresponding collar 36 whose diameter is greater than the inner diameter of the tubular body 32 of the jack screw 10. As such, if the internal pile 8 were to be inserted into the jack screw 10 from above, the collar 36 of the internal pile 8 would abut against the rim 34 of the jack screw 10, thereby preventing the internal pile 8 from traveling further through the jack screw 10.

In the depicted embodiment of the tool 4, a thrust bearing 38 is disposed between the rim 34 of the jack screw 10 and the collar 36. The thrust bearing 38 is contained within an annular side wall 40 of the jack screw 10 which projects upwardly from the rim 34. A second thrust bearing 39 fits over and around the internal pile 8 and sits upon the collar 36. An upper plate 42 through which the internal pile 8 passes is fitted over the second thrust bearing 39 and is secured to the rim 34 of the jack screw 10 via bolts 44. This thrust bearing 38 and 39 engagement between the internal pile 8 and the jack screw 10 enables rotation and restricts longitudinal translation therebetween.

A lower end of the tubular body 32 of the jack screw 10 carries an external thread 46 which is threadingly engageable with the threaded upper section 26 of the external pile 6. In this way, rotation of the jack screw 10 in a first direction causes longitudinal translation of the screw piles 6 and 8 relative to one another. In other words, rotational force (i.e. torque) applied to the jack screw 10 is converted into linear motion of the screw piles 6 and 8 relative to one another.

FIG. 2 shows the tool 4 in a digging state. In the digging state, the upper helix 14 of the external pile 6 physically engages the lower helix 16 from above. This physical engagement between the helices 14 and 16 prevents both the jack screw 10 and the external pile 6 from being rotated in a manner that would lead to the unscrewing of the jack screw 10 and external pile 6 from one another. In other words, the external pile 6 is prevented from being unscrewed from the jack screw 10 by virtue of the lower helix 16 blocking movement of the upper helix 14 and thus the external pile 6.

Figure 3:
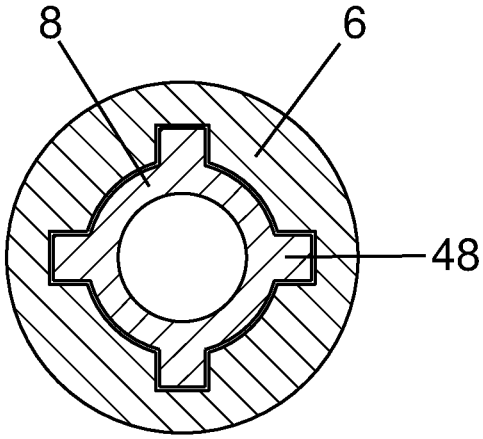
FIG. 3 is a cross sectional end view at an interface between pile-forming members of the tool of FIG. 1.

Both screw piles 6 and 8 are rotationally locked to one another. Referring to FIG. 3, the piles 6 and 8 are engaged with one another in a slot and key arrangement 48 such that neither screw pile 6 and 8 can be rotated independently of the other. In other words, rotation of one pile causes rotation of the other. Of course, the number of slots and keys can vary and the male and female locking relationship between the piles 6 and 8 can be the inverse of what is depicted in FIG. 3.

Figure 4:
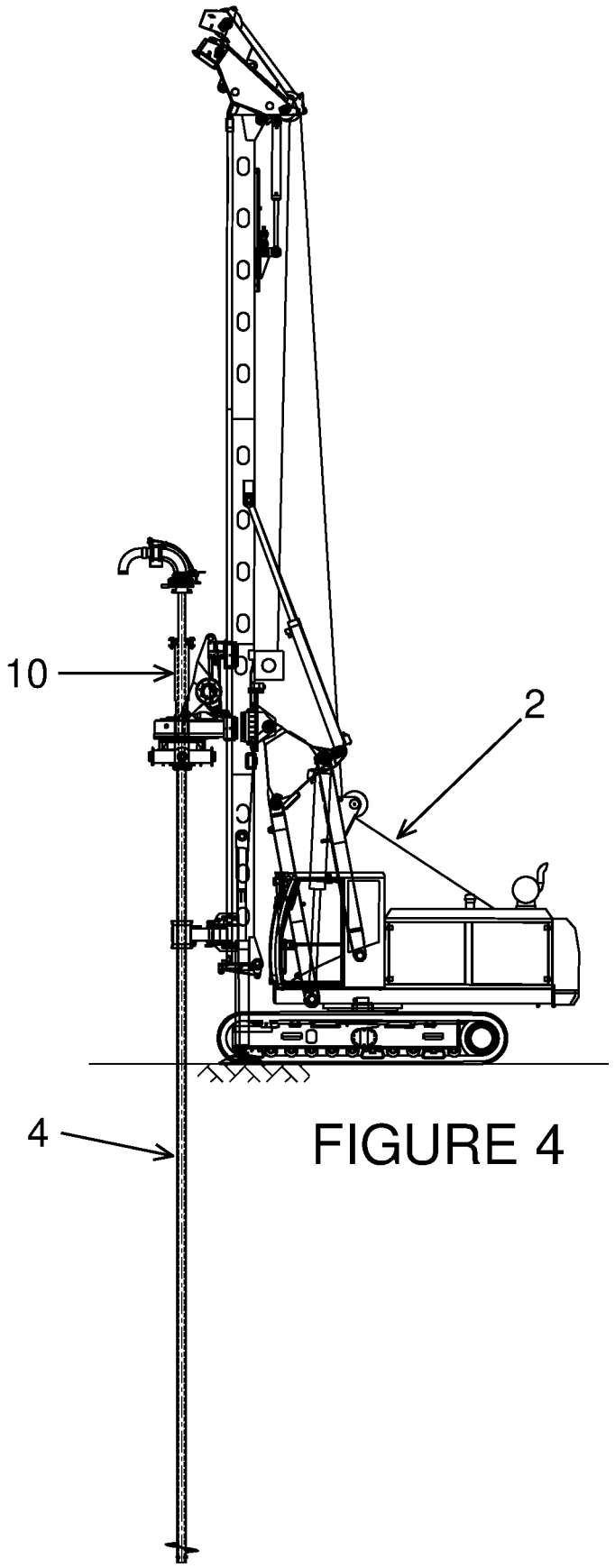
FIG. 4 is a side view of the tool and piling rig of FIG. 1, wherein the tool has been driven underground.

Referring back to FIG. 2, when the tool 4 is in the digging state, the screw piles 6 and 8 can be driven into the ground to a predetermined depth. To this end, torque is applied to the jack screw 10 (e.g. from the rotary head 12 of a piling rig 2) so as to rotate it in a first direction which would notionally unscrew the jack screw 10 and external pile 6 from one another. Since the physical engagement between the helices 14 and 16 prevents such unscrewing (as discussed above), rotation of the jack screw 10 in the first direction simply rotates both screw piles 6 and 8 so that they can be driven into the ground to a predetermined depth. With the helix 14 and 16 of each pile 6 and 8 engaged with one another, the screw piles 6 and 8 can be screwed into the ground as shown in FIG. 4.

Figure 5:
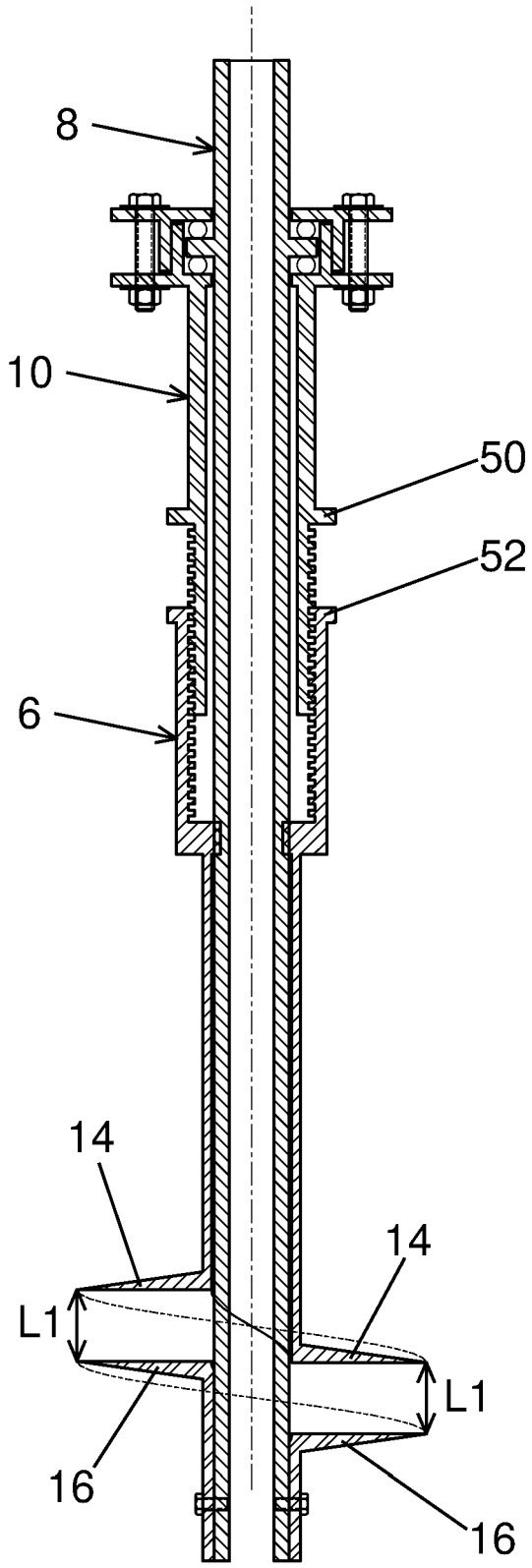
FIG. 5 is a cross sectional side view of the tool of FIG. 1, the pile-forming thereof between the digging state and a base-forming state.

Once the screw piles 6 and 8 have been driven to a predetermined depth, the piling rig operator can start forming the notional void in which the enlarged base is to be constructed. Referring to FIG. 5, the direction of the torque applied to the jack screw 10 is reversed so as to rotate the jack screw 10 in a second direction. This causes the jack screw 10 and the external pile 6 to screw towards one another. Consequently, the helices 14 and 16 are driven apart from one another so that they are spaced from one another in the longitudinal direction, as indicated by reference numeral L1. The separation of the helices 14 and 16 from one another creates a notional underground void with a diameter that approximates the diameter of the helices 14 and 16, and a height that approximates the longitudinal distance L1 between the upper helix 14 and the lower helix 16. As this notional void is formed, the flowable fill is supplied through the tool 4 and exits side outlets 21 (shown in FIG. 6) thereof so as to fill the void and form the enlarged base.

Figure 6:
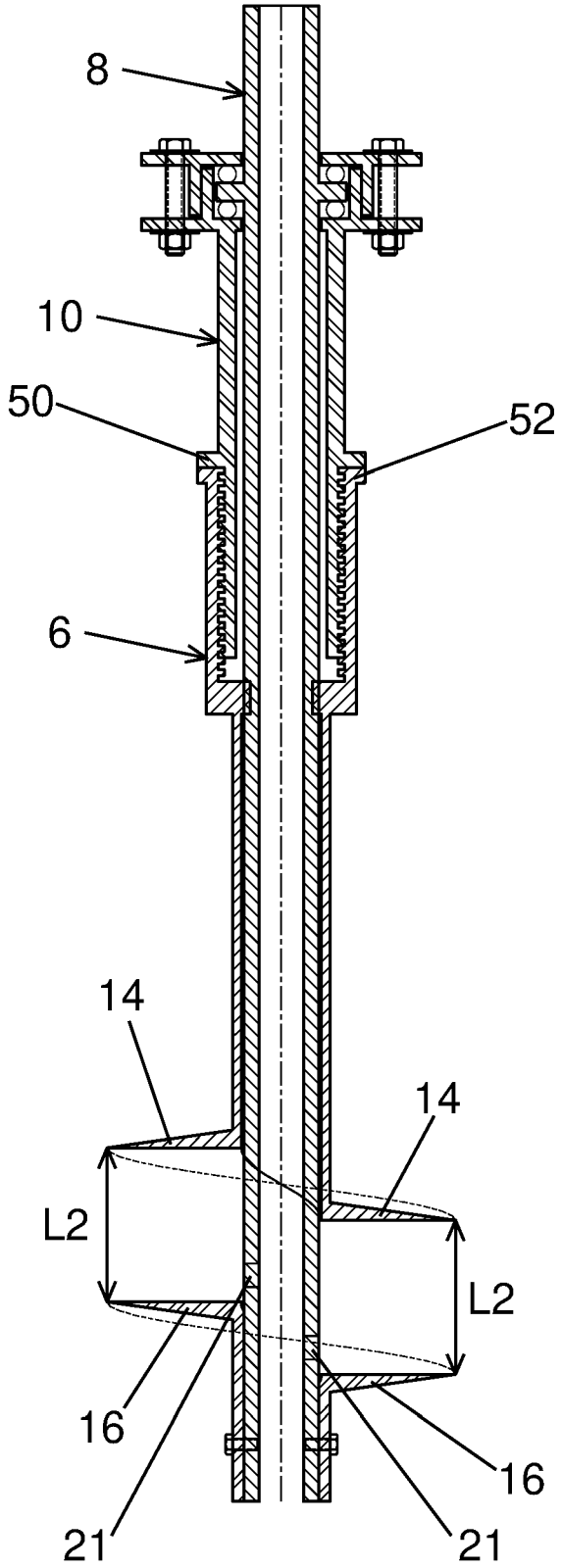
FIG. 6 is a cross sectional side view of the tool of FIG. 1 in the base-forming state.

Referring to FIG. 6, continued rotation of the jack screw 10 in the second direction moves the screw piles 6 and 8 into a base-forming state wherein the helices 14 and 16 are maximally spaced from one another, as indicated by reference numeral L2. The tool 4 may comprise limiting means which restrict further separation between the helices 14 and 16. In the embodiment shown in FIG. 6, the jack screw 10 comprises limiting means in the form of an externally projecting collar 50. The collar 50 defines a surface against which an upper rim 52 of the external pile 6 abuts if the jack screw 10 continues to be rotated in the second direction. By virtue of the external pile 6 physically abutting against the collar 50, further rotation of the jack screw 10 in the second direction does not act to further separate the helices 14 and 16 from one another. As such, the limiting means acts to define the maximum distance L2 the helices 14 and 16 can be spaced from one another in the longitudinal direction.

A method of using the tool 4 will now be described. Referring to FIG. 1, the tool 4 is positioned above the ground and the screw piles 6 and 8 are moved (e.g. via the jack screw 10) so that they assume the digging state wherein the helices 14 and 16 are proximate to and preferably engaged with one another. In other words, the helices 14 and 16 are substantially not spaced from one another in the longitudinal direction, as shown in FIG. 2. The screw piles 6 and 8 can then be drilled underground to a predetermined depth, as shown in FIG. 4.

With reference to FIG. 5, once the screw piles 6 and 8 have been drilled to the predetermined depth, the piling rig operator can apply torque to the jack screw 10 (or external pile 6) via the rotary head 12 in a direction which screws the jack screw 10 and external pile 6 toward one another, so as to begin separating the helices 14 and 16 from one another.

The torque required to separate the helices 14 and 16 can be indicative of ground composition and thus ground quality and stability. The magnitude of this torque can be used to estimate a loading capacity of an enlarged base should an enlarged base be formed at the predetermined depth. As such, as the piling operator separates the two helices 14 and 16 from one another, the operator may note the magnitude of the torque applied. If the torque is below a threshold amount which is indicative of a sufficiently strong enlarged base, then the operator can cease separation of the helices 14 and 16, and instead, move the screw piles 6 and 8 back into the digging state and continue drilling deeper to a second predetermined depth, where the operator can again commence separation of the helices and determine if the applied torque is equal to or greater than the threshold amount. In this way, the depth at which the foundation pile should be installed can be quickly and easily estimated simply by considering the torque that is required to separate the helices 14 and 16. This obviates the alternative of excessively overengineering the foundation pile due to load bearing uncertainty (e.g. digging far deeper than is necessary and constructing foundation piles with diameters far greater than necessary).

It should be noted that forces other than the torque applied to the jack screw can be used to predict the loading capacity of a foundation pile. For example, one or more strain gauges can be fitted to one or both piles 6 and 8 to measure the axial loading thereof as the piles 6 and 8 are moved away from one another. In this way, axial forces in the or each pile 6 and 8 can also be used to predict the load bearing capacity of a foundation pile.

Once the piling rig operator determines that the magnitude of the torque or axial force required to separate the helices 14 and 16 is equal to or greater than a threshold amount which is indicative of a sufficiently strong enlarged base, the operator can continue separating the helices 14 and 16 while supplying the flowable fill through the tool 4 channel 18 and out the side outlets 21 of the internal pile 8. The flowable fill thus gradually fills up the notional void created by the separation of the helices 14 and 16, thereby forming the enlarged base of the foundation pile.

The screw piles 6 and 8 can then be gradually withdrawn (e.g. by backscrewing) from the ground. As the piles 6 and 8 are withdrawn, the flowable fill is supplied through the tool 4 channel 18 and out the outlet 20 so as to fill in the notional void created by the length of the tool 4, thereby forming the shaft of the cast-in-situ pile. The diameter of the shaft approximates the smaller diameter of the tubular bodies of the screw piles 6 and 8, rather than the larger diameter of the helices 14 and 16. In this way, a cast-in-situ foundation pile can be formed with an enlarged base, and the loading capacity of the foundation pile can be known with greater accuracy.

Figure 7:
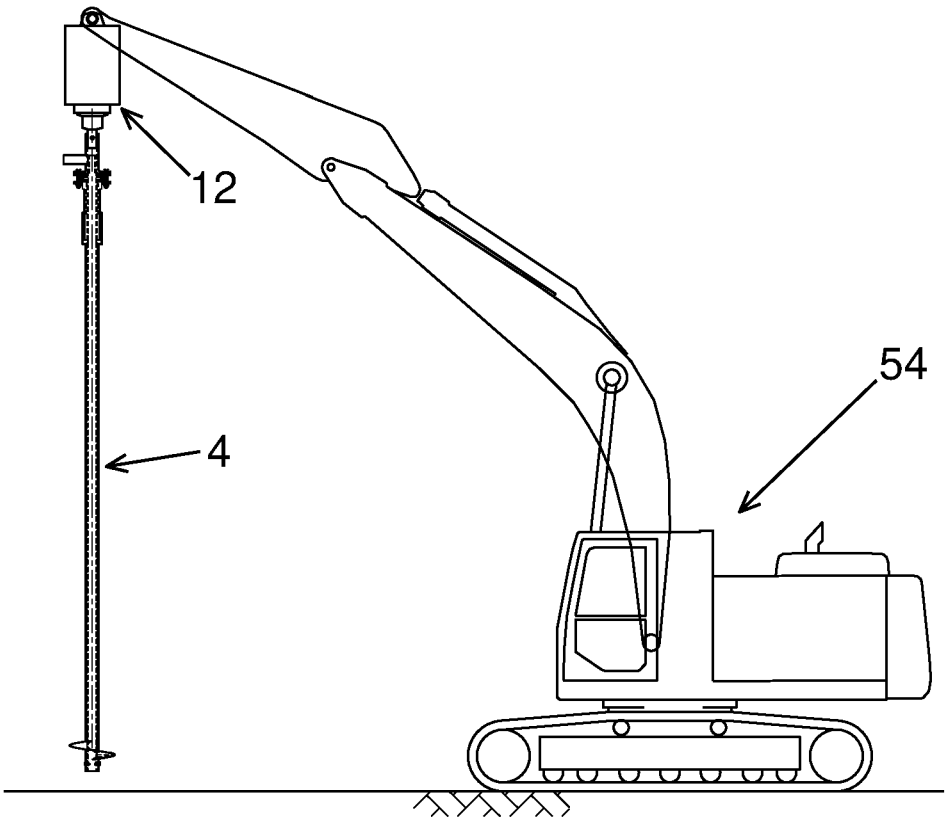
FIG. 7 is a side view of a tool according to embodiments of the present invention fitted to an excavator.

Tools 4 embodying the present invention may also be fitted to and used with other machines, such as an excavator 54. An example is shown in FIG. 7.

Figure 8:
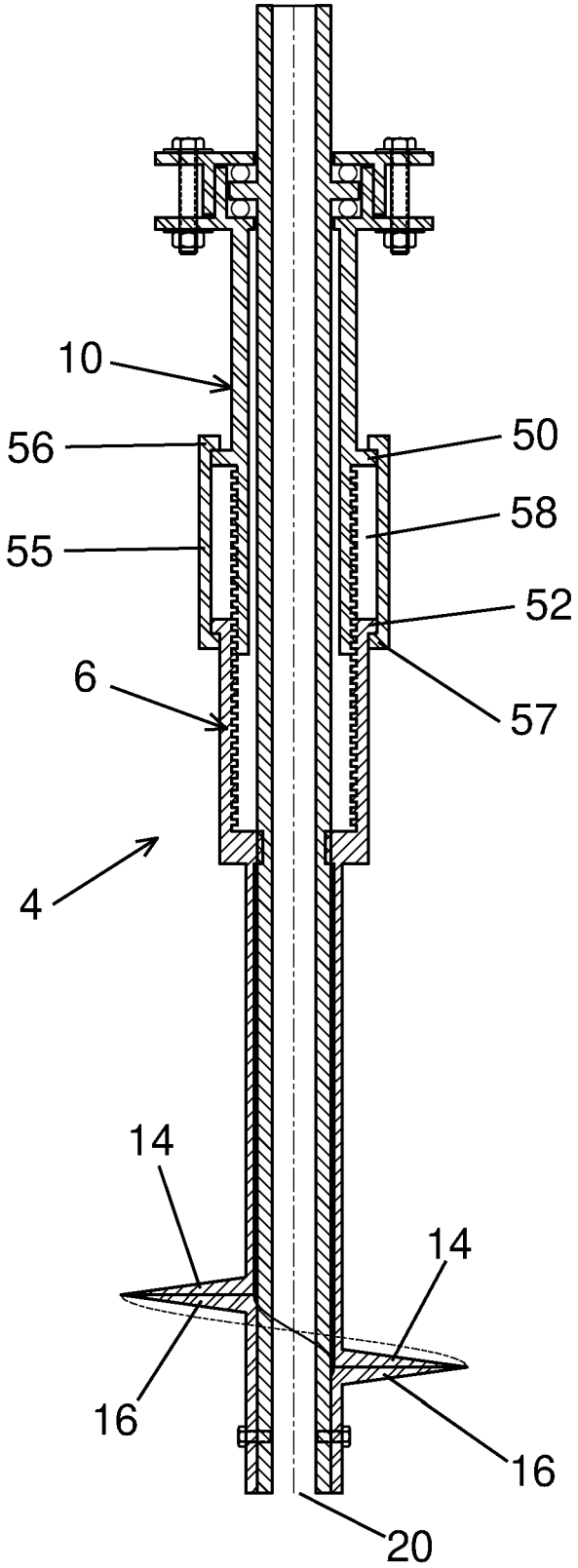
FIG. 8 is a cross sectional side view of a tool according to alternative embodiments of the present invention.

FIG. 8 shows a tool 4 according to embodiments of the invention. The depicted tool is substantially similar to the tool 4 described above, and comprises an additional limiting means 55 which also resists the unscrewing of the external pile 6 from the jack screw 10. In the depicted embodiment, the limiting means is in the form of a tubular collar 55 which fits over the jack screw 10. The limiting collar 55 comprises an inwardly extending upper flange 56 which sits against the projecting collar 50 of the jack screw 10. The limiting collar 55 also comprises an inwardly extending lower flange 57. A longitudinal and annular passageway 58 is defined within the collar 55 and between its upper and lower flanges 56 and 57. Just as the projecting collar 50 of the jack screw 10 restricts longitudinal translation between the piles 6 and 8 which would further separate the helices 14 and 16, the lower flange 57 of the limiting collar 55 restricts longitudinal translation between the piles 6 and 8 which would further unscrew the external pile 6 and jack screw 10 from one another. As can be seen in FIG. 8, further unscrewing of the jack screw 10 and the external pile 6 from one another is restricted by the physical engagement between the upper rim 52 of the external pile 6 and the lower flange 57 of the limiting collar 55.

While various embodiments of the present invention are described, it should be understood that they have been presented by way of example only, and not by way of limitation. It will be apparent to a person skilled in the relevant art that various changes in form and detail can be made therein without departing from the spirit and scope of the invention. For example, the functions, capabilities and features of the internal pile 8 may instead by associated with the external pile 6, and vice versa. Thus, the present invention should not be limited by any of the described exemplary embodiments.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

The reference in this specification to any prior publication (or information derived from it), or to any matter which is known, is not, and should not be taken as, an acknowledge or admission or any form of suggestion that that prior publication (or information derived from it) or known matter forms part of the common general knowledge in the field of endeavour to which this specification relates.

What is claimed is:

1. A tool for forming an underground cast-in-situ pile having an enlarged base, the tool comprising:

a first pile-forming member having a first base-forming member at a lower end thereof;

a second pile-forming member having a second base-forming member at a lower end thereof, the first and second pile-forming members extending collinearly and being movable in a longitudinal direction relative to one another between:

a digging state wherein the first and second base-forming members are proximate to one another so that together, the first and second base-forming members define a leading helix of the tool such that the first and second pile-forming members can be driven underground to form an elongate hole underground having a first diameter; and a base-forming state wherein the first and second base-forming members are spaced apart from one another in the longitudinal direction so as to form an underground void between the first and second base-forming members at a depth of the elongate hole, the void having a second diameter that is greater than the first diameter and being fillable with a flowable fill to form the enlarged base of the underground cast-in-situ pile; and a jack screw, wherein rotation of which causes relative longitudinal movement between the first and second pile-forming members.

2. The tool of claim 1, wherein the jack screw is threadingly engaged with the first pile-forming member such that rotation of the jack screw in one direction moves the first and second pile-forming members into the digging state, and rotation of the jack screw in the opposite direction moves the first and second pile-forming members into the base-forming state.

3. The tool of claim 2, wherein the jack screw and the second pile-forming member are rotatable, but not longitudinally movable, relative to one another.

4. The tool of claim 3, wherein the second pile-forming member comprises a collar via which the jack screw is secured to restrict relative longitudinal movement therebetween, and wherein a thrust bearing is disposed between the jack screw and the second pile-forming member to enable relative rotation therebetween.

5. The tool of claim 1, further comprising limiting means for limiting an extent to which the first and second base-forming members can be spaced from one another.

6. The tool of claim 5, wherein the limiting means comprises a collar extending from the jack screw, and wherein when the first and second pile-forming members are moved into the base-forming state, the first pile-forming member engages the collar, thereby limiting longitudinal movement between the first and second pile-forming members which further increases the space between the first and second base-forming members.

7. The tool of claim 1, wherein the first and second pile-forming members are telescopically arranged and configured such that one of the first and second pile-forming members cannot be rotated independently of the other of the first and second pile-forming members.

8. The tool of claim 1, wherein:

the first pile-forming member is a first screw pile;

the second pile-forming member is a second screw pile;

the first base-forming member is a first helix; and the second base-forming member is a second helix.

9. The tool of claim 8, wherein in the digging state, the first and second helices are engaged with one another to define the leading helix of the tool.

10. The tool of claim 1, wherein:

the first pile-forming member is a first blade pile;

the second pile-forming member is a second blade pile;

the first base-forming member is a first blade; and the second base-forming member is a second blade.

11. The tool of claim 1, wherein:

the first diameter is approximately equal to a diameter of the first pile-forming member and/or a diameter of the second pile-forming member; and the second diameter is approximately equal to a diameter of the first base-forming member and/or a diameter of the second base-forming member.

12. A method of forming an underground cast-in-situ pile having a shaft and an enlarged base, the method using a tool comprising:

a first pile-forming member having a first base-forming member at a lower end thereof;

a second pile-forming member having a second base-forming member at a lower end thereof, the first and second pile-forming members extending collinearly and being movable in a longitudinal direction relative to one another between:

a digging state wherein the first and second base-forming members are proximate to one another so that the first and second pile-forming members can be driven underground to form an elongate hole having a first diameter; and a base-forming state wherein the first and second base-forming members are spaced apart from one another in the longitudinal direction so as to form an underground void between the first and second base-forming members at a depth of the elongate hole, the void having a second diameter that is greater than the first diameter and being fillable with a flowable fill to form the enlarged base of the underground cast-in-situ pile, the method comprising:

(a) when the first and second pile-forming members are in the digging state, driving the first and second pile forming members underground to a predetermined depth to form the elongate hole;

(b) moving the first and second pile-forming members towards the base-forming state to form the underground void at the depth of the elongate hole;

(c) while moving the first and second pile-forming members towards the base-forming state, supplying the flowable fill to the void so as to form the enlarged base of the underground cast-in-situ pile; and (d) driving the first and second pile-forming members out of ground while supplying the flowable fill underground to form the shaft of the cast-in-situ pile.

13. The method of claim 12, wherein step (b) further comprises:

(i) while moving the first and second pile-forming members towards the base-forming state, determining a magnitude of a force required to move the first and second pile-forming members towards the base-forming state;

(ii) if the magnitude of the determined force is below a threshold amount, repeating steps (a) and (b) at a deeper depth underground until the magnitude of the determined force is equal to or greater than the threshold amount; and (iii) when the magnitude of the determined force is equal to or greater than the threshold amount, continuing to move the first and second pile-forming members towards the base-forming state while supplying the flowable fill to the void to form the enlarged base.

14. The method of claim 13, wherein the force relates to a torque force applied to a jack screw of the tool configured to move the first and second pile-forming members towards the base-forming state.

15. The method of claim 13, wherein the force relates to an axial force carried by one or both of the first and second pile-forming members.

* * * * *